United States Patent [19]

Kompelien

[11] Patent Number: 5,073,769

[45] Date of Patent: Dec. 17, 1991

[54] FLAME DETECTOR USING A DISCRETE FOURIER TRANSFORM TO PROCESS AMPLITUDE SAMPLES FROM A FLAME SIGNAL

[75] Inventor: Arlon D. Kompelien, Crosslake, Minn.

[73] Assignee: Honeywell Inc., Minneapolis, Minn.

[21] Appl. No.: 608,054

[22] Filed: Oct. 31, 1990

[51] Int. Cl.[5] ..... G08B 17/12

[52] U.S. Cl. ..... 340/578; 250/554; 364/576

[58] Field of Search ..... 340/578; 250/554; 364/576, 550

[56] References Cited

U.S. PATENT DOCUMENTS

| | | | |
|---|---|---|---|
| 4,709,155 | 11/1987 | Yamaguchi | 340/578 |
| 4,750,142 | 6/1988 | Akiba et al. | 364/550 |
| 4,785,292 | 11/1988 | Kern et al. | 340/578 |
| 4,866,420 | 9/1989 | Meyer, Jr. | 340/578 |
| 4,983,853 | 1/1991 | Davall | 340/578 |

OTHER PUBLICATIONS

Japanese open application 61-130833, titled "Flame Monitor", author-Koji Yamamoto, 6/86.

*Primary Examiner*—Jin F. Ng
*Assistant Examiner*—C. Oda
*Attorney, Agent, or Firm*—Edward Schwarz

[57] ABSTRACT

A circuit for detecting presence of a flame receives a flame signal from a standard photocell positioned to receive radiation from the flame and digitally processes the amplitude variations in the photocell's output to sense for the presence of frequencies near a frequency which is characteristic of a flame. The frequencies substantially higher than the characteristic frequency are filtered from the signal, and the remaining signal is sampled at a frequency which is preferably four times the characteristic frequency. The samples are converted to digital values and processed using a discrete Fourier transform. If the value resulting from the transform operation exceeds a preselected value, presence of a flame is essentially certain. Such digital processing allows use of a dedicated microcircuit or a microprocessor for the flame sensing function and avoids the need for many large discrete components.

7 Claims, 4 Drawing Sheets

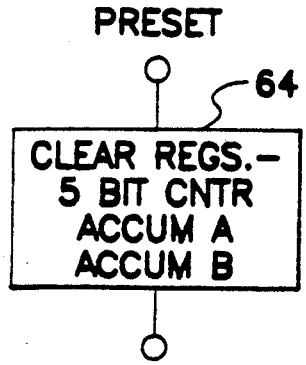
Fig. 3A
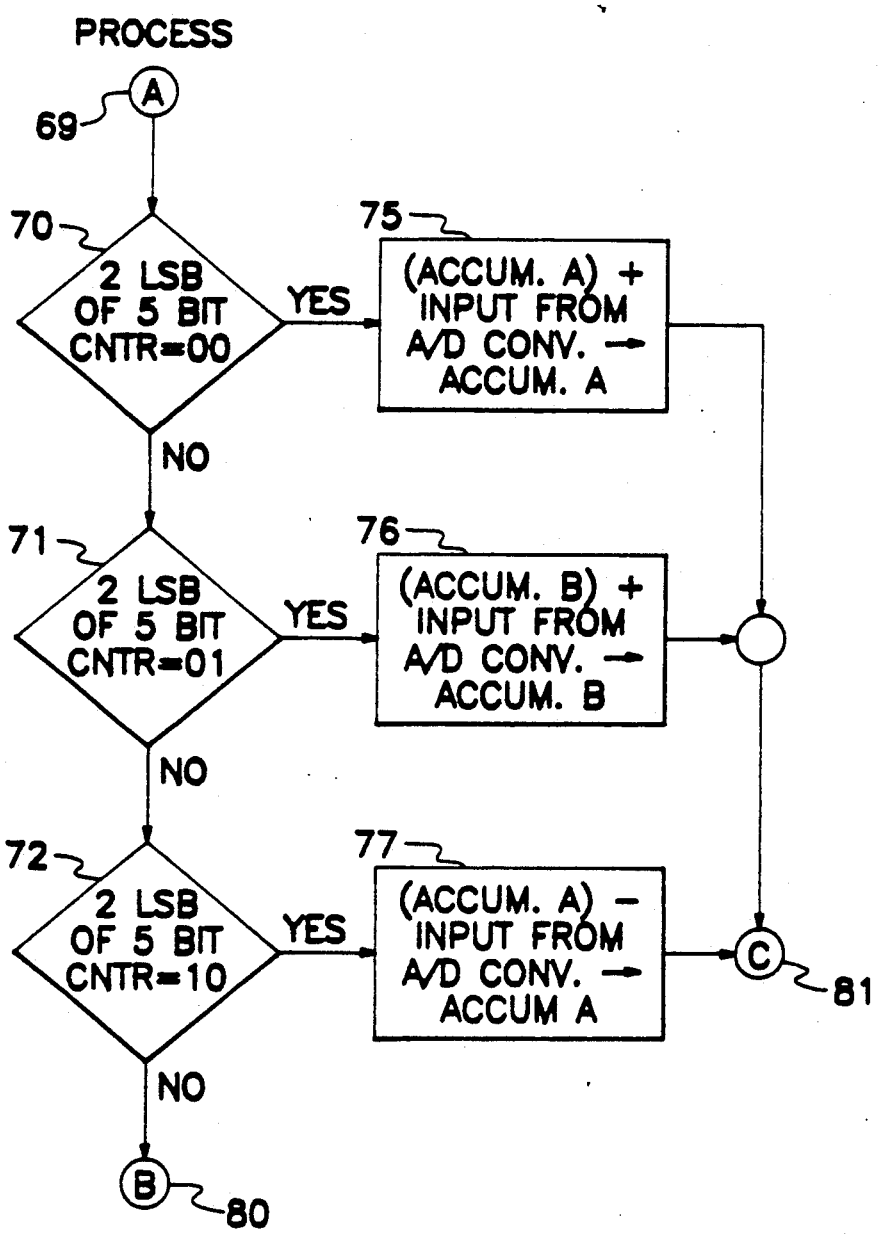

FLAME DETECTOR USING A DISCRETE FOURIER TRANSFORM TO PROCESS AMPLITUDE SAMPLES FROM A FLAME SIGNAL

BACKGROUND OF THE INVENTION

In fuel burners such as furnaces where the main burner is lit by a pilot burner, it is necessary for obvious reasons to assure that the pilot burner is lit before the main burner fuel valve is opened. This is true whether a standing pilot or intermittent pilot is involved. While there are many different types of sensing operations which can reliably detect presence of a pilot flame, one which is preferred senses the flicker frequency of typical pilot flames. This flicker is a periodic variation of the intensity or amplitude of the infrared, visible, or ultraviolet radiation produced by the burning of the fuel sustaining the pilot flame. The flicker frequency of this radiation in most cases has a component in the range of 13–17 hz. This characteristic is fairly independent of the fuel and the size of the pilot flame.

In the past an analog circuit has been used to sense for presence of this flicker in the intensity of the radiation emanating from the location of the pilot flame. However, the relatively large size of components for an analog-based flame sensing system for the low frequencies involved here, cannot be easily included on a single circuit board with the smaller digital and logic-based circuits which are now more and more often being used to implement other functions of typical fuel burners. This necessitates a separate flame sensor board or a larger single board with a larger power supply, resulting in turn in undesirable expense and inconvenience.

BRIEF DESCRIPTION OF THE INVENTION

The so-called fast Fourier transform (FFT) is a mathematical algorithm which has been used for signal frequency analysis for some time. When one desires to sense the presence of frequencies in a neighborhood of a particular single frequency, one can use a variation of the FFT called the discrete Fourier transform (DFT). A circuit for detecting presence of a radiation source such as a pilot flame having a significant flicker in its energy within a predetermined frequency range may use a particular variation of the DFT for the purpose of pilot flame detection. Such a circuit receives from a photocell a flame signal instantaneously representative of the intensity of the energy emanating from the flame. A simple analog low pass filter receives the flame signal and providing a filtered flame signal from which a substantial percentage of the amplitude of frequencies above the predetermined frequency range has been removed. This prevents the higher frequencies from simulating the flicker frequency of interest, a condition known as "aliasing", which is possible when using a DFT.

A clock circuit provides a clock signal having individual pulses at four times the frequency of the midpoint of the predetermined frequency range. For a common flicker frequency of 15 hz., it is convenient to use the normal 60 hz. power as the source of the clock signal. An analog to digital converter receives the filtered flame signal and the clock signal, samples the filtered flame signal responsive to each clock signal pulse, and provides a digital flame signal having a plurality of successive discrete, ordinally designated, digital values each encoding the amplitude of the filtered flame signal at successive sampling instants over a predetermined sampling interval. A first accumulator register receives the digital flame signal and forms from the plurality of digital values comprising the flame signal, the sum of the difference of successive pairs of even numbered ordinal digital values and provides at the end of each sampling interval a first intermediate digital transform signal encoding the current contents of the first accumulator register. A second accumulator register receives the digital flame signal and forms the sum of the difference of successive pairs of odd numbered ordinal digital values for the predetermined sampling interval, and provides at the end of each sampling interval a second intermediate digital transform signal encoding the current contents of the second accumulator register.

A calculator means receives the first and second intermediate digital transform signals from their respective accumulator registers and provides a transform signal digitally encoding a value at least approximately equal to the square root of the sum of the square of the digital values encoded in each of the first and second intermediate digital transform signals. That is, the actual computed value encoded in the transform signal to be used in the next phase of the operation of this apparatus should have at least the accuracy of an approximation of the precise value. A comparator means receives the transform signal from the calculator means and compares the value encoded in the transform signal with a predetermined transform constant value, and if greater than the transform constant value, issues a flame sense signal signifying presence of flame.

All of these elements except for the photocell analog low pass filter, and clock means can be formed by the proper programming of a microprocessor, and in fact this is the preferred embodiment for the invention.

Accordingly, one purpose of the invention is to reduce the size and power requirements of the flame sensing system in a burner control system.

A second purpose of the invention is to allow the flame sensing system to be included in the micro electronics package containing the control circuitry for the burner.

Yet another purpose of the invention is to allow changes in the sensitivity and response of the flame detector by software means only.

A further purpose is to increase the accuracy and reliability in detecting presence of a flame in a burner.

BRIEF DESCRIPTION OF THE DRAWINGS

FIGS. 3A and 3B flow diagram of instructions which may be loaded into the microprocessor of FIG. 2 to implement the invention.

DESCRIPTION OF THE PREFERRED EMBODIMENTS

Figure 1:
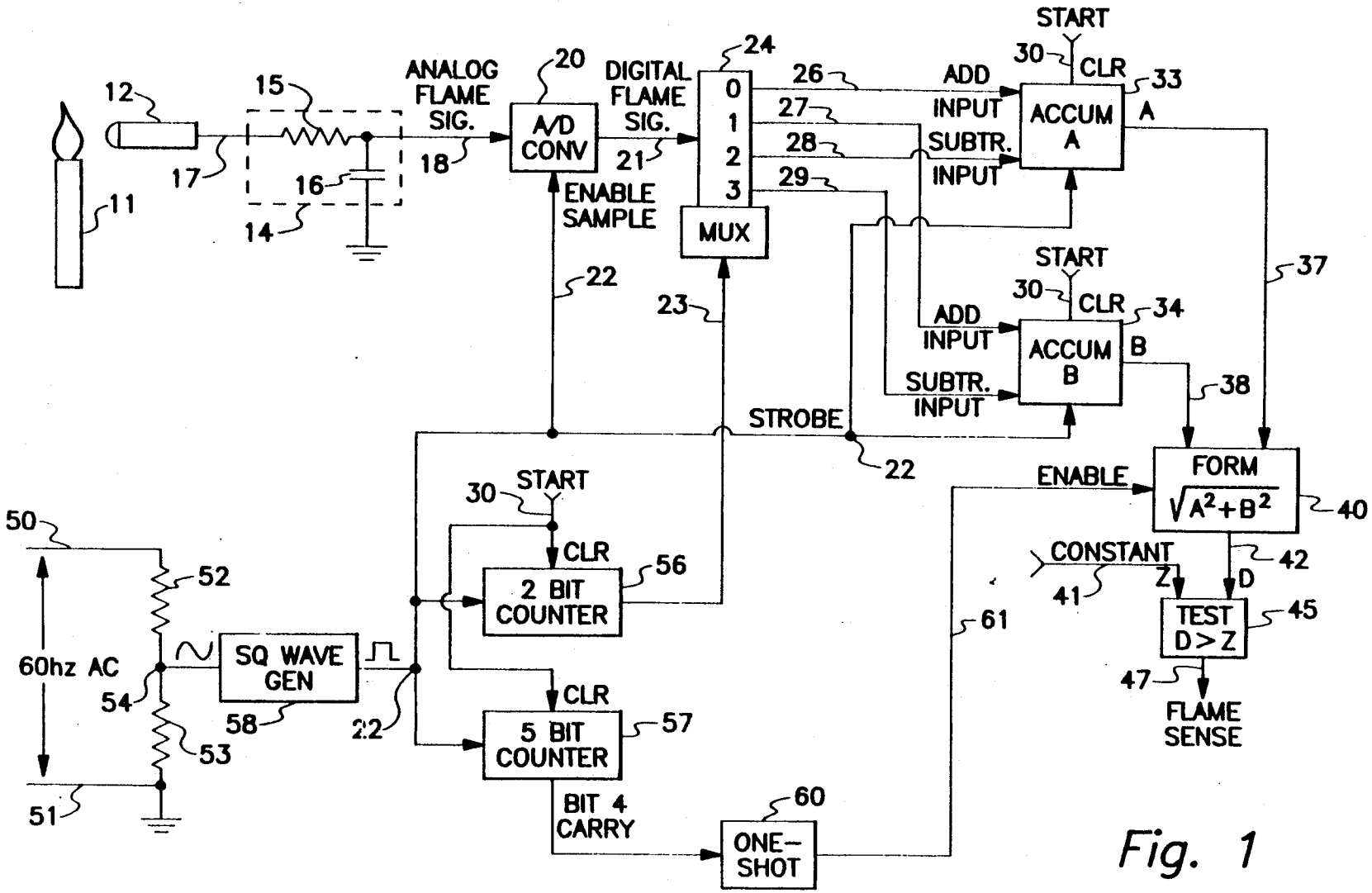
FIG. 1 is a block diagram of electrical circuit employing discrete components to implement the invention.

This invention is for detecting a flame which has in its energy output intensity a flicker whose frequency is within a predetermined frequency range. The detection process used involves the so-called discrete Fourier transform (DFT) calculation to sense the presence of a component of the flicker frequency in the flame. In FIG. 1, a conventional burner 11, which may be a pilot burner such as is used in a conventional furnace or heater, produces a flame sensed by a photocell 12. The photocell 12 provides a flame signal on path 17 which is instantaneously representative of the intensity of the energy emanating from the flame. For the typical pilot flame, there a frequency component in this flame signal within the 13–17 hz. range whose presence is a sufficient condition for the presence of a pilot flame, even though there are invariably many other frequencies present in the composite signal as well. This frequency component arises from the flow velocity, pressure, and combustion characteristics of the gaseous fuel supplying the typical pilot burner 11, and is independent of the size or design of the pilot burner itself. However, the overall signal energy of this frequency component is substantially less than the signal energy of other frequencies present These other frequencies typically are radiated by the hot surfaces of the furnace interior after the pilot flame goes out, and thus of course provide no indication of the presence of any pilot flame. Accordingly, it is necessary to carefully tune a detector intended to sense presence of this frequency component, to detect frequencies within this 13–17 hz. range.

The flame signal on path 17 is filtered by a low pass filter 14 which comprises a series resistor 15 and a shunt capacitor 16 as shown. Preferably filter 14 has a cutoff frequency of approximately 20 hz., so that the amplitude of frequencies above 20 hz. is substantially attenuated. The output of filter 14 is a filtered flame signal on path 18 which is supplied to an analog to digital (A/D) converter 20. In response to an enable sample signal on path 22, A/D converter 20 provides a digital flame signal on path 21 which digitally encodes the digital value of the amplitude of the filtered flame signal at the instant that the enable sample signal on path 22 occurred. The range of converter 20 must be great enough to assure that there is no clipping of the input voltage level of the filtered flame signal reflected in the digital output. The enable sample signal is provided at fixed intervals by other circuitry of FIG. 1, and it is strongly preferred that the enable sample signal occur at four times the rat of the flame signal frequency to be detected. Other sampling rates are possible, but any other rate involves substantially more complicated calculations to determine the DFT value of interest. When the invention is implemented within a simple and low powered microprocessor, complicated calculations are not easy to make, and such an implementation is the most likely. For the remainder of this description, the sampling rate of four times the DFT frequency will be assumed.

One can consider the output of A/D converter 20 as comprising a series of successive discrete, ordinally designated, digital values each encoding the magnitude of the filtered flame signal on path 18 at successive sampling instants occurring at the fixed enable sample rate. If a specific digital value is chosen as the first for a detection calculation, then it and the succeeding values may also be ordinally designated as well, as $x_0$, $x_1$, etc., with the subscripts forming the successive ordinal designations of the digital sample values.

The elements of FIG. 1 which will now be discussed will typically form parts of a microprocessor which is programmed to at the appropriate instants of time, perform the functions which the elements involved provide. In fact, many such microprocessors also include an A/D converter 20 as part of the package containing the microprocessor.

The digital flame signal on path 21 is supplied to the input of an output multiplexer 24. Such a multiplexer has a number of output paths 26–29, each of which has a unique address. The multiplexer 24 provides the binary digits encoded on its digital data input path 21 to the one of the output paths 26–29 whose address is specified by the address encoded in the signal on an address path 23. All of the output paths 26–29 except for the one designated by the two bit address path 23 carry a digital value of zero. That is, the digital data on the input path 21 is carried by the output path 26, 27, 28 or 29 of multiplexer 24 accordingly as the input on the two bit address path 23 encodes a zero, one, two, or three. Output paths 26–29 which are not designated by the two bit address on path 23 encode a digital value of zero.

To understand the processing which is performed using the digital flame signal provided on path 21 it is useful to examine the mathematical expression of the discrete Fourier transform (DFT) which is employed here. A flicker signal generated when flame is present will almost always have a detectable frequency component at 15 hz. using the system being described, and will essentially never have such a component when no flame is present. As mentioned earlier, one can consider the A/D converter 20 as providing a plurality of successive discrete, ordinally designated, digital values each encoding the magnitude of the filtered flame signal on path 18 at successive sampling instants. The general theory for calculating a DFT for a waveform can be considerably simplified when the values of the waveform are sampled at a rate four times that of the DFT target frequency. In this simplified case, calculating the DFT involves forming two related summations to be explained shortly. For the purpose of reliably detecting presence of a pilot flame, it has been found to be sufficient to continue the summation over eight successive cycles of the 15 hz. frequency component. In the first summation, the sum of the difference of successive pairs o digital values having even ordinal designations must be formed. For the second summation, the sum of the difference of successive pairs of digital values having odd ordinal designations must be formed. If the first series value is designated A, and the ordinal designation of the successive digital values is represented by a subscript of from 0 to 31, then $A=x_0-x_2+x_4-x_6+\ldots+x_{28}-x_{30}$. (Equation 1) Similarly, the equation for the second series summation of the digital values can be written as $B=x_1-x_3+x_5-x_7+\ldots+x_{29}-x_{31}$. (Equation 2) The DFT for this wave form as sampled by converter 22 at these precise intervals is then given by $D=(A^2+B^2)^{\frac{1}{2}}$. (equation 3) It is possible to use other than precisely 32 samples for a single calculation, but I have found 32 to be adequate for accurate and reliable flame detection without excessive calculations or time required. At any rate, with this detection algorithm, the number of samples involved in a single evaluation should be a multiple of four.

To allow sampling to occur at exactly four times the rate of the target frequency of 15 hz., the enable sample signal must occur at 60 times per second. It is extremely convenient to use the standard 60 hz. power wave form as the clock which generates the enable sample signal on path 22 which controls the sampling of the filtered flame signal on path 18. Accordingly, a 60 hz. AC signal on paths 50 and 51 is placed across a voltage divider comprising resistors 52 and 53. The common point 54 of these resistors provides a low voltage 60 hz. sine wave input to a square wave generator 58 which produces a 60 hz. square wave output on path 22. As mentioned earlier of course, the individual square wave pulses on path 22 enable successive samples of the filtered flame signal on path 18. The square wave signal on path 22 is also provided to a two bit counter 56 and a five bit counter 57 to increment the contents of each of these counters by one each time a pulse is provided to the input on path 22. It can be seen that two bit counter 56 counts from 0 to 3 decimal (0 to 11 binary) and then returns to 0 and continues cycling in that manner. Similarly, five bit counter 57 advances by one in response to each pulse on path 22 and after reaching 31 (11111 binary) returns to 0 and continues to advance with each additional pulse. It may well be more convenient to use the two least significant bits of five bit counter 57 as two bit counter 56, and this is completely acceptable.

For sequencing purposes, it is necessary to employ a start signal provided by some external controller on path 30. With respect to counters 56 and 57, this signal is applied to clear (CLR) inputs which cause the counter 56 or 57 to be reset to 0. In addition, counter 57 provides a carry from its high order bit, bit 4 (the low order bit being bit 0), to indicate that 32 pulses have been applied to it since the counter 57 was last cleared. This bit 4 carry signal is applied to a one shot 60 which provides an output pulse whose duration is set by the internal characteristics of one shot 60.

Multiplexer 24 along with an A accumulator 33 and a B accumulator 34 are the circuit elements directly involved with forming the two series summations of equations 1 and 2. While these two accumulators are shown here as discrete hardware elements, it is very likely that in a preferred embodiment using a microprocessor, these accumulators will be individual registers within the microprocessor memory. In such a case, the arithmetic unit of the microprocessor alternately cooperating with each of the registers to function as a part of one or the other of the accumulators. Each accumulator 33 or 34 has an add input and a subtract input, as the labeling indicates. Data on add input path 26 or 28 is added to the value stored in an accumulator 33 or 34 respectively responsive to a strobe signal on path 22. Similarly, the data on subtract path 27 or 29 is subtracted from the value in the respective accumulator 33 or 34 responsive to a strobe signal on path 22. It can thus be seen that individual digital values comprising the digital flame signal on path 21 are gated to one of the four output paths 26–29 of multiplexer 24 according to the value contained in two bit counter 56, and each is then added to or subtracted from the respective accumulator contents. The start signal on path 30 clears the accumulators 33 and 34 prior to forming these two series. It can be seen that as two bit counter 56 continuously increments from 0 through 3, resets back to 0 and counts up again through 3, each digital value from A/D converter 20 which is presented on path 21 when the two bit counter 56 is 0 is provided on path 26 to accumulator A 33 to be added to its contents. When the contents of two bit counter 56 equals 1 the digital value on path 21 is provided to accumulator B 34 to be added to its contents. When the contents of two bit counter 56 equals 2 then the digital value on path 21 is provided on path 28 to be subtracted from the contents of accumulator A 33. And lastly when the contents of two bit counter 56 equals 3 then the digital value on path 21 is gated to path 29 or subtraction from the contents of accumulator B 34.

This sequence of cycling incrementally through two bit counter 56 occurs precisely eight times at which time five bit counter 57 crosses from a decimal value of 31 to 0 and a carry is provided on the bit four carry output of counter 57. In this way exactly 32 sequential digital values are made available to compute the A and B summation series. The bit four carry signal is used to set one shot 60 which provides an enable signal on path 61 to a first arithmetic element 40 which receives the series summations in the A accumulator 33 and the B accumulator 34 on path A 37 and path B 38 respectively. Arithmetic module 40 computes the value $(A^2+B^2)^{\frac{1}{2}}$ and provides a digital representation D of this value encoded in a signal on path 42. It is possible to employ an approximation for computing the value of D, and one possible formula for an acceptable approximation is explained in connection with the software implementation of FIGS. 3A and 3B. Thus, it may be said that if D is calculated by such an approximation, it is at least approximately equal to the precise value of D, and such precision is typically acceptable.

The value D is the actual DFT value for the flame signal on path 17 at 15 hz. To determine whether the 15 hz. frequency amplitude component in the flame signal on path 17 is sufficiently strong to indicate the presence of a flame, the value D is tested to be greater than a constant value Z provided on path 41, and this test is performed by a digital comparator shown as test element 45. As with the accumulators 33 and 34, this test element will usually comprise circuitry within a microprocessor. If the inequality is true then a flame sense signal is provided on path 47. This flame sense signal may be used for example as a precondition for opening the main valve of a burner, since this inequality assures that a pilot flame is present. The value Z should normally be equal to approximately four to five times the peak voltage of the filtered flame signal applied to the input of the A/D converter 20, taking into account any scale factor which the A/D converter uses in determining the individual digital values indicative of the instantaneous flame signal voltage.

Figure 2:
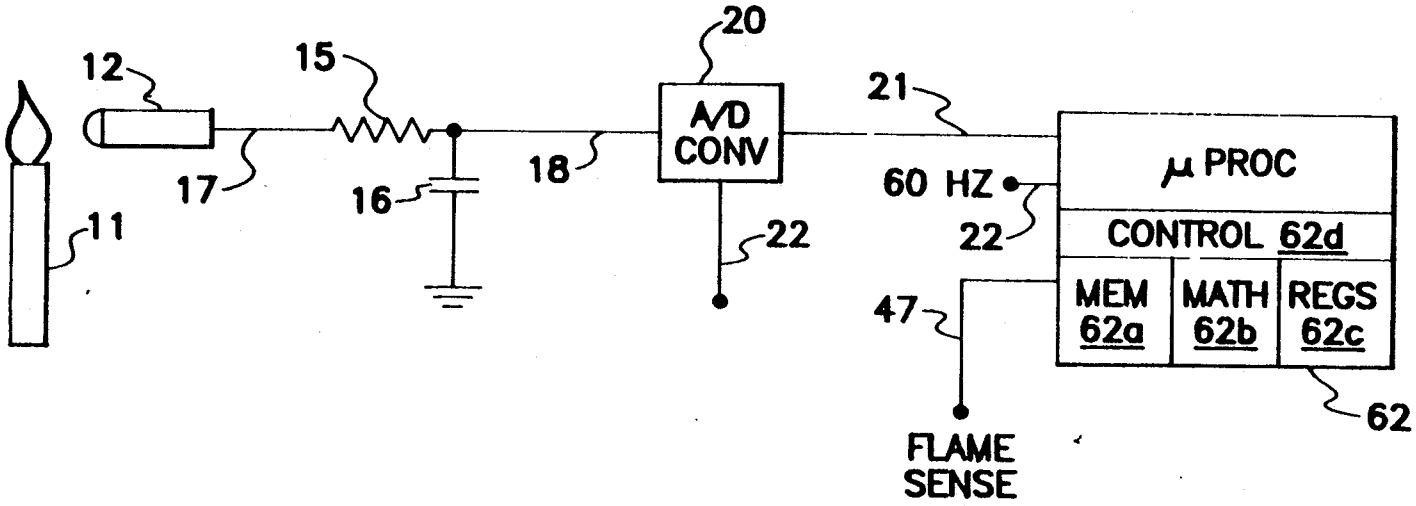
FIG. 2 is a block diagram of a system implementing the invention using a microprocessor to perform the functions of the digital and logical blocks of FIG. 1.

While FIG. 1 is a block diagram of a dedicated discrete component system for performing the operations of this invention, FIG. 2 shows a system having identical functions but implemented with a microprocessor 62 which performs all of the functions shown in FIG. 1 except for the square wave generation and initial signal acquisition and filtering. Such a microprocessor is currently available on the market with input channels such as shown connected to input paths 21 and 22 and a memory **62*a* in Which instructions for accomplishing the computations of a DFT may be stored. Such a microprocessor 62 also includes computational and arithmetic capabilities in circuitry 62*b*, data storage in registers 62*c* which typically comprise a random access memory, and overall control and decision making capabilities in the circuitry shown generally as 62*d*. In particular, the instructions stored in memory 62*a* are selected so as to cause microprocessor 62 to function as the individual elements shown in FIG. 1 as directed by the instructions in memory 62*a***.

Figure 3B:
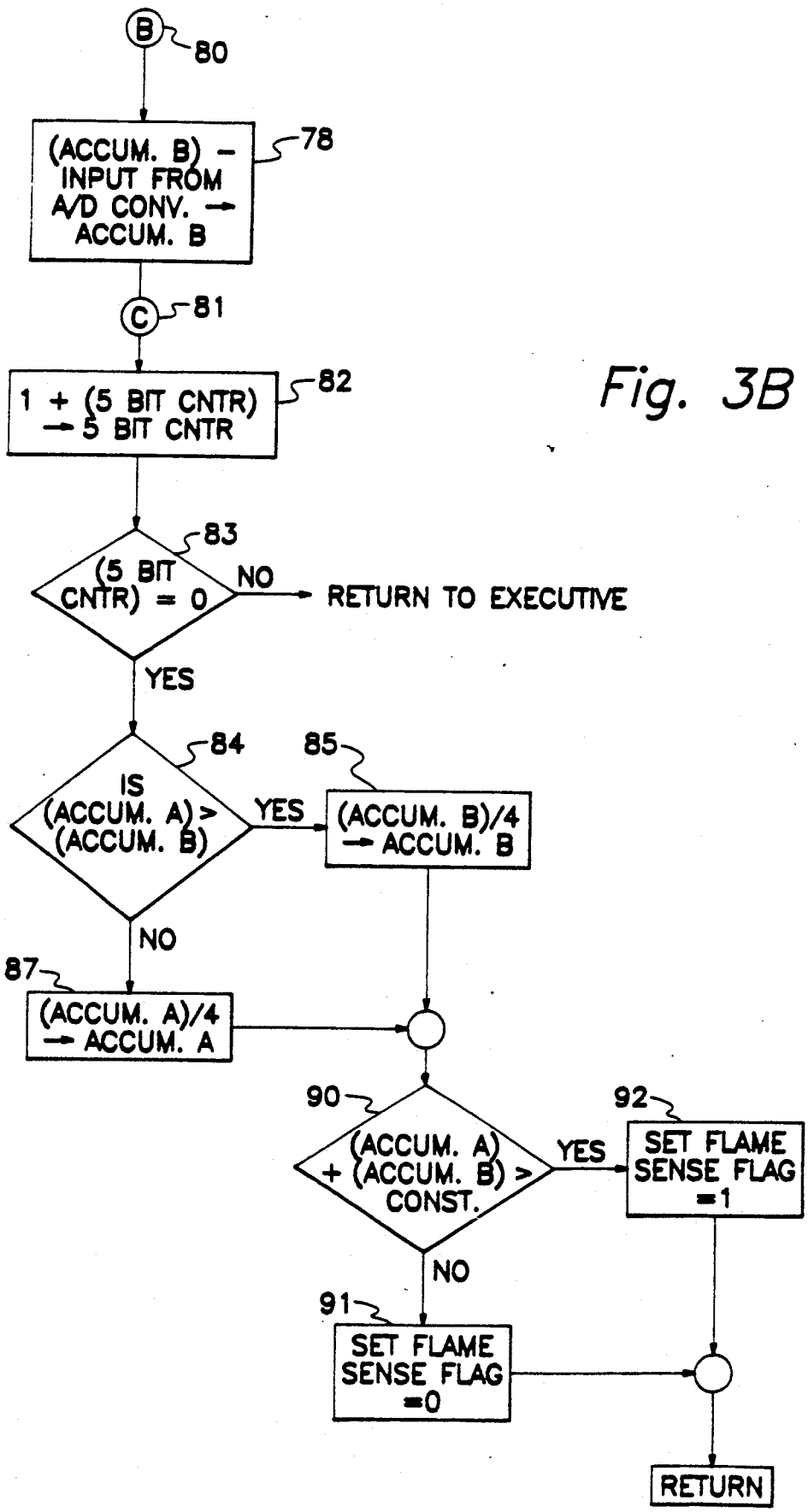

FIGS. 3A and 3B together form a flow chart of instructions which will direct microprocessor 62 to function as the individual elements shown in FIG. 1. In FIGS. 3A and 3B, rectangular boxes are activity elements which denote instructions performing arithmetic and data transfer operations. Diamond-shaped boxes denote decision making elements. Within individual activity elements, a horizontal arrow denotes transfer of data identified o the left side of the arrow to the location specified on the right side of the arrow. Parentheses conventionally indicate the numeric or logical contents or value of whatever register or element is contained within the parentheses. It should be understood that microprocessor 62 will typically have many other functions to perform besides those related to this invention. In particular, there will typically be a control or executive software module which directs individual operating modules of the software to execute their functions as appropriate. Typically, some signal will be provided within microprocessor 62 which will eventually culminate in what is shown in FIG. 1 as the start signal encoded in the signal on path 30.

It is desirable to test for flame at many times during a complete burner operating sequence, and each of these individual test times will typically be selected by microprocessor 6 operations. Each time that such a test time occurs, a short preset routine comprising instructions forming activity element 64 are executed. These presetting instructions clear five bit counter which may be a register forming one of the registers 62*c*, and also clear the A and B accumulators which will typically comprise two other registers of the registers 62*c*. The internal signals of microprocessor 62 which initiate this presetting operation correspond to the start signal carried on path 30 of the circuit of FIG. 1.

The 60 hz. square wave signal is applied to an input 22 of microprocessor 62 which causes an internal interrupt within microprocessor 62 transferring execution of instructions to the A connector element 69 shown in FIG. 3A, meaning that instructions commencing with decision element 70 and those following will be executed. The execution of instructions by microprocessor 62 is so fast compared with the 60 hz. sampling rate of A/D converter 20 that in every case the entire calculation plus whatever other functions which it may be necessary for microprocessor 62 to perform, have occurred before the next interrupt to connector element 69 occurs. The internal interrupt signal is simply one form of the enable sample signal on path 22 of FIG. 1. As shown in FIGS. 1 and 2, the signal on path 22 is also provided to an A/D converter 20 which provides a digital flame signal on path 21 to an input channel of microprocessor 62.

The flow chart elements starting with connector 69 perform the actual update on a digital value to a digital value basis for computing the A and B summation series discussed earlier. After the last of the 32 values for a single DFT computation has been received and processed, the actual DFT value D is computed and compared with the constant shown on path 41 in FIG. 1, to determine presence of a flame. In this embodiment, it is likely that this constant is internally stored by microprocessor 62. Decision elements 70–72 and activity elements 75–78 compute the actual values of the A and B summation series. It is convenient to use the two least significant bits (LSB) of the five bit counter which counts the total number of digital data values provided by the A/D converter 20 to determine the position in the ordinal designation of each digital value and hence what series and what sign is required when the value is summed with the accumulator A or B value.

As indicated by decision element 70, if the two least significant bits (LSB) of the five bit counter equal 00 (binary) then execution passes to the instructions represented by activity element 75. These instructions read up the input from A/D converter 20 currently available on the associated input channel and read up the contents of the register functioning as accumulator A, add these two values together and store the value back into the register functioning as accumulator A.

If the two least significant bits of the five bit counter equal 01 binary, then the instructions of decision element 71 cause the instructions of activity element 76 to be executed. These instructions represented by element 76 take the input from the A/D converter 20, add that digital value to the contents of the register functioning as accumulator B, and stores this sum back into accumulator B.

If the two least significant bits of the five bit counter are unequal to 01, then execution of instructions instead passe to the instructions represented by decision element 72. If the instructions of decision element 72 find the two least significant bits of the five bit digital value counter to be equal to 10 (binary), then execution passes to the instructions represented by activity element 77. Instructions of this element 77 cause the contents of the register serving as accumulator A to be read up, and then the input from the A/D converter 20 to be read up and subtracted from the contents of accumulator A. This difference is then stored back into accumulator A.

If the two least significant bits of the five bit counter are unequal to 00, 01, and 10 as sensed by the instructions of decision elements 70–72, then control is transferred to the instructions comprising activity element 78 as symbolized by the B connector 80. The instructions of element 78 cause the contents of the register functioning as accumulator B to be read up and from this value the input from the A/D converter 20 is subtracted. This difference value is then stored back into the register serving as accumulator B. It can be seen that the instructions symbolized by the activity and decision elements discussed above for computing the values in accumulators A and B in essence cause the microprocessor 62 to momentarily comprise multiplexer 24 and the A and B accumulators 33 and 34 of FIG. 1.

After one of the instruction groups for elements 75, 76, 77, or 78 have been executed during a pass through the program and the digital flame signal value has been added to or subtracted from the appropriate accumulator, control then passes to C element connector 81 and the instructions symbolized by activity element 82. The instructions of this element 82 simply increment the contents of the five bit counter by 1 and store that value back into the five bit counter. Then the contents of the five bit counter are tested, and if equal to 0 this implies that the contents of the counter has advanced to 32 (decimal) on the previous pass through this sequence of instructions because this last increment by the instructions of element 82 changed the value from 31 to 0. If the counter value is unequal to 0 then control is returned to the executive portion of the software module for further processing of other functions of the burner control system. If however, the five bit counter is equal to 0 then the A and B summation series of equations 1 and 2 has been computed, and the value $D=(A^2+B^2)^{\frac{1}{2}}$ can be computed.

Because the small microprocessors likely to be used in these applications typically perform multiplications and extract square roots very slowly, it is frequently preferable to use an approximation so as to save instruction execution time for other functions. An appropriate approximation here is given by $(A^2+B^w)^{\frac{1}{2}} \sim A + B/4$, where A>B. The division by 4 can be accomplished easily with a right shift of the value of B two binary places. This approximation is accurate to within 5% for the values which will typically occur for A and B, and 5% is more than adequate accuracy. Of course, the reader understands that where B>A, that B +A/4 must be calculated.

To implement this approximation algorithm, the instructions represented by decision element 84 compares the magnitude A of the contents of accumulator A with the magnitude B of the contents of the register containing accumulator B, and if A>B, then the instructions represented by activity element 85 are executed. These instructions cause the contents of accumulator B to be right shifted two places, which is the same as a divide by 4 without rounding, and then store this right shifted value back into the register functioning as accumulator B. If B>A, then the result of activity element 87 is that value A is divided by 4 by a right shift of two and this result stored back into the register functioning a accumulator A. Then regardless of whether the instructions of activity elements 85 or 87 were executed, instruction execution proceeds with those represented by decision element 90. The sum of the contents of the registers functioning as accumulators A and B are compared with a constant value and if the sum is greater than the constant value then the instructions represented by activity element 92 are executed. These instructions set a flame sense flag equal to 1, which symbolizes that flame has been detected. The flame sense flag value may be made available externally on path 47 if desired, or may be used as the criteria for further operations in a burner operation sequence If the sum of the contents of the registers functioning as accumulators A and B is equal to or less than the constant value, then the flame sense flag is cleared by the instructions which activity element 91 represents. In either case, then operation returns to the executive portion of the program for further operation in the burner control sequence.

The preceding describes my invention.

What I wish to claim by letters patent is:

1. A flame sensing system for providing a flame sense signal responsive to receiving a flame signal from a photocell receiving radiative energy from a flame having in its energy output intensity a flicker whose frequency is within a predetermined frequency range, said flame signal instantaneously representative of the intensity of the energy emanating from the flame, the system comprising a) a low pass filter receiving the flame signal and providing a filtered flame signal from which a substantial percentage of the amplitude of frequencies above the predetermined frequency range has been removed;

b) a clock circuit providing a clock signal having individual pulses at four times the frequency of the midpoint of the predetermined frequency range;

c) an analog to digital converter receiving the filtered flame signal and the clock signal, sampling he filtered flame signal responsive to each clock signal pulse, and providing a digital flame signal having a plurality of successive discrete, ordinary designated, digital values each encoding the amplitude of the filtered flame signal at successive sampling instants;

d) a fist accumulator register receiving the digital flame signal and forming from the plurality of digital values in the flame signal, the sum of the difference of successive pairs of digital values having even oridinal designations, and providing after a sampling instant a first intermediate digital transform signal ascending he current contents o the fist accumulator register;

e) a second accumulator register receiving the digital flame signal and forming from the plurality of digital values in the flame signal, the sum of he difference of successive pairs of digital values having odd ordinal designations, and providing after a sampling instant a second intermediate digital transform signal encoding the current contents of the second accumulator register;

f) a calculator means receiving the first ad second intermediate digital transform signals, and providing a transform signal at lest approximately equal o the square root of the sum of the squares of the digital value encoded in each of the fist and second intermediate digital transform signals; and g) a comparator means receiving he transom signal for comparing the digital value encoded in the transform signal with a predetermined transform constant value, and if generator than the transform constant value, issuing a flame sense signal signifying presence of flame.

2. The sensing system of claim 1 adapted for detecting a flame having a flicker frequency range of approximately 13 to 17 hz., where the clock circuit has a pluse rate of 60 hz. and wherein the low pass filter has a cutoff frequency of approximately 20 hz.

3. The sensing system of claim 1 wherein the clock circuit comprises a signal generator receiving a 60 hz. AC signal input and providing a 60 hz. square wave logic level signal whose frequency is that of the AC signal input.

4. The sensor of claim 1 wherein the calculator means comprises means for comparing the digital value encoded in the first intermediate digital transform signal with that encoded in the second intermediate digital transform signal, selecting the larger of the two intermediate digital transform signals, and forming the sum of the larger of the digital values encoded in the intermediate digital transform signals and one fourth of the smaller of the digital values encoded in the intermediate digital transform signals, and encoding this value in the transform signal.

5. A flame sensing system for providing a flame sense signal responsive to receiving a flame signal from a photocell receiving radiative energy from a flame having a flicker in its energy intensity whose frequency is within a predetermined frequency range, said flame signal instantaneously representative of the intensity of the energy emanating from the flame, the system comprising a) a low pass filter receiving the flame signal and providing a filtered flame signal from which a substantial percentage of the amplitude of frequencies above the predetermined frequency range has been removed;

b) a clock circuit providing a clock signal having individual pulses at four times the frequency of the midpoint of the predetermined frequency range;

c) an analog to digital converter receiving the filtered flame signal and the clock signal, sampling the filtered flame signal responsive to each clock signal pulse, and providing a digital flame signal having a plurality of successive discrete, ordinally designated, digital values each encoding the amplitude of the filtered flame signal at successive sampling instants; and d) a microprocessor for executing instructions and including data registers, an instruction memory containing a plurality of instructions, and a digital input channel, said microprocessor instruction memory including instructions for causing the microprocessor to function as:

i) a first accumulator register receiving through the input channel the digital flame signal from the analog to digital converter and forming from the plurality of digital values in the flame signal, the sum of the difference of successive pairs o f digital values having even ordinal designations, and providing at the end of each sampling interval a first intermediate digital transform signal encoding the current contents of the first accumulator register;

ii) a second accumulator register receiving through the input channel the digital flame signal from the analog to digital converter and forming from the plurality of digital values in the flame signal, the sum of the difference of successive pairs of digital values having odd ordinal designations, and providing at the end of each sampling interval a second intermediate digital transform signal encoding the current contents of the second accumulator register;

iii) a calculator means receiving the first and second intermediate digital transform signals and providing a transform signal approximating the square root of sum of the squares of the digital values encoded in each of the first and second intermediate digital transform signals; and iv) a comparator means receiving the transform signal for comparing the digital value encoded in the transform signal with a predetermined transform constant value, and if greater than the transform constant value, issuing a flame sense signal signifying presence of flame.

6. The flame sensing system of claim 5 adapted for detecting a flame having a flicker frequency range of approximately 13 to 17 hz., where the clock circuit has a pulse rate of 60 hz. and wherein the low pass filter has a cutoff frequency of approximately 20 hz.

7. The sensor of claim 5 wherein the calculator means comprises means for comparing the digital value encoded in the first intermediate digital transform signal with that encoded in the second intermediate digital transform signal, selecting the larger of the two intermediate digital transform signals, and forming the sum of the larger of the digital values encoded in the intermediate digital transform signals and one fourth of the smaller of the digital values encoded in the intermediate digital transform signals, and encoding this value in the transform signal.

* * * * *

UNITED STATES PATENT AND TRADEMARK OFFICE

CERTIFICATE OF CORRECTION

PATENT NO. : 5,073,769

DATED : December 17, 1991

INVENTOR(S) : Arlon D. Kompelien

It is certified that error appears in the above-identified patent and that said Letters Patent is hereby corrected as shown below:

Column 9, line 59, cancel "he" and substitute --the--.
Column 9, line 62, cancel "ordinary" and substitute --ordinally--.
Column 10, line 2, cancel "oridinal" and substitute --ordinal--.
Column 10, line 4, cancel "ascending he" and substitute --encoding the--
Column 10, line 8, cancel "he" and substitute --the--.
Column 10, line 14, cancel "ad" and substitute --and--.
Column 10, line 16, cancel "o" and substitute --to--.
Column 10, line 18, cancel "fist" and substitute --first--.
Column 10, line 20, cancel "he transom" and substitute --the transform--.
Column 10, line 23, cancel "generator" and substitute --greater--.

Signed and Sealed this

Thirtieth Day of March, 1993

*Attest:*

STEPHEN G. KUNIN

*Attesting Officer*

*Acting Commissioner of Patents and Trademarks*